United States Patent [19]

Mewissen et al.

[11] 4,181,930

[45] Jan. 1, 1980

[54] LAMP REFLECTOR UNIT

[75] Inventors: Jan A. C. Mewissen; Ferdinandus M. J. Van Beek, both of Eindhoven, Netherlands

[73] Assignee: U.S. Philips Corporation, New York, N.Y.

[21] Appl. No.: 823,401

[22] Filed: Aug. 10, 1977

[30] Foreign Application Priority Data

Aug. 23, 1976 [NL] Netherlands ..... 7609323

[51] Int. Cl.[2] ..... F21V 7/00; F21V 1/22

[52] U.S. Cl. ..... 362/296; 362/347; 362/350

[58] Field of Search ..... 362/347, 296, 80, 350

[56] References Cited

U.S. PATENT DOCUMENTS 3,414,762 12/1968 Wyzykowski ..... 362/80 X

*Primary Examiner*—Stephen J. Lechert, Jr.

*Attorney, Agent, or Firm*—Robert S. Smith

[57] ABSTRACT

A lamp reflector unit to be used for projection purposes and comprising a reflector body and a light source accommodated therein. The reflector body is covered with a reflective layer extending from the top of the reflector body up to a distance from the largest circumferential edge of the reflector body. The distance is between 3 mm and 10 mm, dependent on the desired angle of divergence of the reflected beam light rays.

2 Claims, 1 Drawing Figure

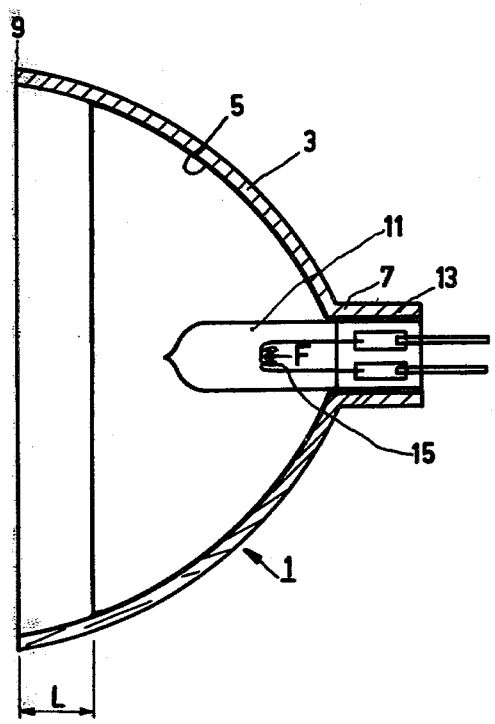
9
5
3
11
7
13
F
15
1
L

LAMP REFLECTOR UNIT

The invention relates to a lamp reflector unit to be used for projection purposes and comprising a cup-shaped reflector body having a reflective layer, an electrical light source being arranged in said reflector body. Such a lamp reflector unit is disclosed in German Utility Model No. 7438222.

The inner surface of the reflector body of such a known lamp reflector unit is covered entirely with a reflective layer reflecting the rays emitted by the light source.

The known lamp reflector unit is used in film and slide projection apparatuses. For that purpose the projection apparatuses comprise means with which the unit can be secured in the projection apparatus. In most modern projection apparatuses, notably in film projection apparatuses, the connection means are standardized and are suitable only for receiving likewise standardized lamp reflector units of which the largest circumferential edge of the reflector body has a prescribed diameter. Said diameter is 50 mm for a lamp reflector unit suitable for a sub-standard film projection apparatus.

The optical systems occurring in projection apparatus often differs considerably. The difference mainly resides in the aperture of the objective. It has been found that in a number of projection apparatus the beam of rays emitted by the standardized lamp reflector unit has too large an angle of divergence, as a result of which a part of the beam does pass through the film window but does not pass through the objective. Since light sources, and notably electrical filaments, emit thermal radiation in addition to light, the result of the use of a known unit in these cases is that the film in the film window is heated excessively, which may result in damage to the film. Although it is known to provide thermal filters between the lamp reflector unit and the film window, which filters intercept a part of the beam of radiation, said filters nevertheless also result in a reduced light intensity on the screen.

It is the object of the invention to provide a solution to the thermal problem described while maintaining the standardized dimensions of the lamp reflector unit.

For that purpose, the lamp reflector unit according to the invention is characterized in that, taken from the top of the reflector body, the reflective layer extends up to a distance from the largest circumferential edge of the reflector body, said distance being between 3 mm and 10 mm.

The advantage of the lamp reflector unit according to the invention is that the value of the reflective surface area of the reflector body can be adapted to the various optical systems used in the projection apparatuses, it being not necessary to change the dimensions of the unit.

It has been demonstrated experimentally that a noticeable reduction of the thermal load in the film window occurs already when the distance over which no reflective layer is provided, is at least 3 mm. It has furthermore been found that the maximum distance may be 10 mm, since when the unmirrored zone is larger, the reflected beam of radiation is too narrow.

The invention permits of providing any modern projector with a standardized lamp reflector unit which causes a minimum thermal load in the film window and nevertheless provides the desired light intensity on the screen.

A preferred embodiment of the lamp reflector unit according to the invention is characterized in that the distance is between 5 mm and 9 mm. The distance is preferably 7 mm.

The reflector body may be in the form of a part of a solid of revolution, for example a paraboloid or an ellipsoid. It generally consists of a transparent material, for example glass, the inner surface of the reflector body—from the top of the reflector up to a distance from the largest edge of the reflector,—being coated with a reflective metal layer, preferably aluminum.

The reflector body may alternatively be a metal. In that case a zone of the inner surface which adjoins the largest circumferential edge and which, dependent on the use of the lamp reflector unit, has a width between 3 mm and 10 mm, should be avoided from reflecting; this can be realized, for example, by providing said zone with a heat-absorbing layer, for example a layer of paint.

The light source may be an electrical incandescent lamp whose filament is arranged axially, or transversally, with respect to the optical axis of the lamp reflector unit.

For completeness' sake it is to be noted that lamp reflector units are known in which the thermal problem, to which the invention provides a solution, occurs to a smaller extent. Such units have a reflector body the surface of which is covered with a so-called cold-light mirror which is composed of a number of interference layers. Such a reflector body reflects the light rays emitted by the light source and passes a part of the emitted thermal rays. A disadvantage of these units is that the provision of the various layers on the surface of the reflector body has to be carried out very carefully, notably the thickness and the composition of each interference layer being very critical.

The invention will now be described in greater detail with reference to the drawing.

The drawing is a longitudinal sectional view through the axis of the lamp reflector unit according to the invention.

A reflector body 1 of pressed glass formed as a part of an ellipsoid is provided on its inner surface with a reflective layer 5 of aluminium extending from the top 7 up to a distance L from the largest circumferential edge 9 of the reflector body 3. The distance L over which the reflector body 3 is not mirrored is determined by the optical system of the projector (not shown) in which the lamp reflector unit 1 is used. The diameter of the unit 1 at the area of the edge 9 is such that the unit 1 fits in the standardized connection means of the projector. In this embodiment the unit is suitable for a sub-standard film projector. The diameter at the edge 9 is 50 mm and the distance L is 7 mm. The unit furthermore comprises an incandescent lamp 11 which is connected in the neck 13 of the reflector body 3. The tungsten filament 15 of the incandescent lamp 11 is arranged so that the focus F of the reflector lies within the filament.

What is claimed is:

1. A lamp reflector unit to be used for projection purposes and comprising a cup-shaped reflector body, said body having a reflective layer, an electrical light source disposed within said reflector body, said reflective layer extending over the interior of said reflector up to a distance from the largest circumferential edge of said reflector body, said distance being between 3 mm and 10 mm.

2. A lamp reflector unit as claimed in claim 1, wherein said distance is between 5 mm and 9 mm.

* * * * *